US009175505B2

(12) United States Patent
Hirukawa

(10) Patent No.: US 9,175,505 B2
(45) Date of Patent: Nov. 3, 2015

(54) DOOR HANDLE ASSEMBLIES AND VEHICLES HAVING SAME

(71) Applicant: Honda Motor Co., Ltd., Minato-ku, Tokyo (JP)

(72) Inventor: Masayuki Hirukawa, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 310 days.

(21) Appl. No.: 13/760,130

(22) Filed: Feb. 6, 2013

(65) Prior Publication Data

US 2014/0217770 A1 Aug. 7, 2014

(51) Int. Cl.

| | |
|---|---|
| ***E05C 3/02*** | (2006.01) |
| ***E05B 85/24*** | (2014.01) |
| ***E05C 3/12*** | (2006.01) |
| ***E05C 3/24*** | (2006.01) |
| ***E05C 3/22*** | (2006.01) |
| ***E05B 85/18*** | (2014.01) |
| *E05B 3/00* | (2006.01) |

(52) U.S. Cl.

CPC ..... *E05B 85/243* (2013.01); *E05B 85/18* (2013.01); *E05C 3/12* (2013.01); *E05C 3/22* (2013.01); *E05C 3/24* (2013.01); *Y10T 292/57* (2015.04)

(58) Field of Classification Search

CPC ..... E05C 3/22; E05C 3/24; E05C 3/26; E05C 3/16; E05C 3/14; E05C 3/122

USPC ..... 292/194, 200, 226, 336.3, DIG. 31

See application file for complete search history.

(56) References Cited

U.S. PATENT DOCUMENTS

| | | | | | |
|---|---|---|---|---|---|
| 2,138,251 | A | * | 11/1938 | Lindstrom et al. | 292/198 |
| 2,381,633 | A | * | 8/1945 | Young | 292/341.17 |
| 3,433,519 | A | * | 3/1969 | Brasseur | 292/336.3 |
| 4,475,415 | A | | 10/1984 | Yamamoto | |
| 4,703,961 | A | * | 11/1987 | Weinerman et al. | 292/216 |
| 4,703,963 | A | * | 11/1987 | Ball | 292/336.3 |
| 4,911,487 | A | * | 3/1990 | Rachocki | 292/216 |
| 4,924,582 | A | | 5/1990 | Keller | |
| 5,127,686 | A | * | 7/1992 | Gleason et al. | 292/216 |
| 5,234,238 | A | * | 8/1993 | Takimoto | 292/216 |

(Continued)

OTHER PUBLICATIONS

Door handle arrangement on 2011 Honda MUV700 3A, as shown at http://www.partsfish.com/ocmparts/a/ hon/ 5232036ef8700225f8c6d0a9/door; retrieved on Jan. 28, 2014; 2 pages, with enlarged portions shown on 2 additional pages, and generally depicted in CAD drawing shown on 1 additional page; admitted to be in public domain prior to Feb. 6, 2012.

*Primary Examiner* — Carlos Lugo

(74) *Attorney, Agent, or Firm* — Ulmer & Berne LLP

(57) ABSTRACT

A door handle assembly for a vehicle includes a mount structure, a door handle, and a latch assembly. The door handle includes an interface portion and a mounting portion. The interface portion includes inner and outer surfaces. The mounting portion is pivotally coupled with the mount structure such that the door handle is pivotable about a first axis between first and second positions. The latch assembly includes a latch body and an actuator arm pivotally coupled with the latch body. The latch body is attached to the mount structure. The actuator arm is pivotable between released and actuated positions. The door handle is configured to contact the actuator arm during at least a portion of the pivotal movement of the door handle from the first position to the second position, forcing the actuator arm to pivot from the released position to the actuated position. Vehicles are also provided.

18 Claims, 4 Drawing Sheets

(56) References Cited

U.S. PATENT DOCUMENTS

| | | | | | |
|---|---|---|---|---|---|
| 5,299,844 | A * | 4/1994 | Gleason | 292/240 |
| 5,564,295 | A * | 10/1996 | Weinerman et al. | 70/208 |
| 5,586,458 | A * | 12/1996 | Weinerman et al. | 70/208 |
| 5,630,630 | A * | 5/1997 | Price et al. | 292/128 |
| 5,875,948 | A * | 3/1999 | Sadler | 224/404 |
| 5,884,948 | A * | 3/1999 | Weinerman et al. | 292/216 |
| 6,070,923 | A | 6/2000 | Tanimoto et al. | |
| 6,073,397 | A | 6/2000 | Tanimoto et al. | |
| 6,134,841 | A | 10/2000 | Schneider | |
| 6,158,787 | A * | 12/2000 | Kutschat | 292/214 |
| 6,419,284 | B1 * | 7/2002 | Kutschat | 292/56 |
| 6,454,325 | B1 | 9/2002 | Ramsey et al. | |
| 6,471,260 | B1 * | 10/2002 | Weinerman et al. | 292/216 |
| 6,651,467 | B1 * | 11/2003 | Weinerman et al. | 70/208 |
| 6,695,361 | B1 * | 2/2004 | Gleason et al. | 292/216 |
| 6,942,259 | B2 * | 9/2005 | Marzolf et al. | 292/216 |
| 7,070,225 | B2 | 7/2006 | Herrmann | |
| 7,234,329 | B2 * | 6/2007 | Mazolf et al. | 70/277 |
| 7,267,377 | B2 * | 9/2007 | Marzolf et al. | 292/25 |
| 7,387,321 | B2 * | 6/2008 | Tanaka et al. | 292/336.3 |
| 7,726,707 | B2 * | 6/2010 | Simchayoff et al. | 292/216 |
| 8,439,409 | B2 * | 5/2013 | Uto et al. | 292/340 |
| 8,894,105 | B2 * | 11/2014 | Kutschat et al. | 292/214 |
| 2004/0239125 | A1 * | 12/2004 | Chen | 292/216 |
| 2006/0006668 | A1 * | 1/2006 | Hidding et al. | 292/216 |
| 2006/0012184 | A1 * | 1/2006 | Ottesen et al. | 292/216 |
| 2007/0080553 | A1 * | 4/2007 | Kim | 296/37.1 |
| 2007/0200358 | A1 * | 8/2007 | Chen | 292/216 |
| 2008/0217929 | A1 * | 9/2008 | Zweibohmer | 292/216 |
| 2009/0134638 | A1 * | 5/2009 | Kutschat | 292/216 |
| 2011/0030280 | A1 * | 2/2011 | Kaita et al. | 49/394 |
| 2011/0156438 | A1 | 6/2011 | Ichihara et al. | |
| 2012/0161427 | A1 | 6/2012 | Tsumiyama et al. | |
| 2012/0260700 | A1 * | 10/2012 | Matre | 70/91 |
| 2012/0261929 | A1 * | 10/2012 | Bruck | 292/226 |
| 2012/0291358 | A1 | 11/2012 | Konchan et al. | |

* cited by examiner

DOOR HANDLE ASSEMBLIES AND VEHICLES HAVING SAME

TECHNICAL FIELD

Disclosed herein are door handle assemblies and vehicles having door handle assemblies.

BACKGROUND

Some conventional utility vehicles include a door which assists in protecting properly seated and secured operators during a rollover situation or a situation involving a significant lateral incline of the vehicle.

SUMMARY

In accordance with one embodiment, a door handle assembly is provided for a vehicle. The door handle assembly comprises a mount structure, a door handle, and a latch assembly. The door handle comprises an interface portion and a mounting portion. The interface portion comprises an inner surface and an outer surface. The mounting portion is pivotally coupled with the mount structure such that the door handle is pivotable about a first axis between a first position and a second position. The latch assembly comprises a latch body and an actuator arm pivotally coupled with the latch body. The latch body is attached to the mount structure. The actuator arm is pivotable between a released position and an actuated position. The door handle is configured to contact the actuator arm during at least a portion of the pivotal movement of the door handle from the first position to the second position, forcing the actuator arm to pivot from the released position to the actuated position.

In accordance with another embodiment, a vehicle comprises a frame, a body, a striker, and a door. The body is supported by the frame. The striker is coupled with at least one of the body and the frame. The door is coupled with at least one of the body and the frame, and is movable between opened and closed positions. The door comprises a door handle assembly. The door handle assembly comprises a mount structure, a door handle, and a latch assembly. The door handle comprises an interface portion and a mounting portion. The interface portion comprises an inner surface and an outer surface. The mounting portion is pivotally coupled with the mount structure such that the door handle is pivotable about a first axis between a first position and a second position. The latch assembly comprises a latch body and an actuator arm pivotally coupled with the latch body. The latch body is attached to the mount structure. The actuator arm is pivotable between a released position and an actuated position. The latch assembly is configured to selectively engage the striker to retain the door in the closed position. The door handle is configured to contact the actuator arm during at least a portion of the pivotal movement of the door handle from the first position to the second position, forcing the actuator arm to pivot from the released position to the actuated position.

BRIEF DESCRIPTION OF THE DRAWINGS

Various embodiments will become better understood with regard to the following description, appended claims and accompanying drawings wherein:

DETAILED DESCRIPTION

Figure 1:
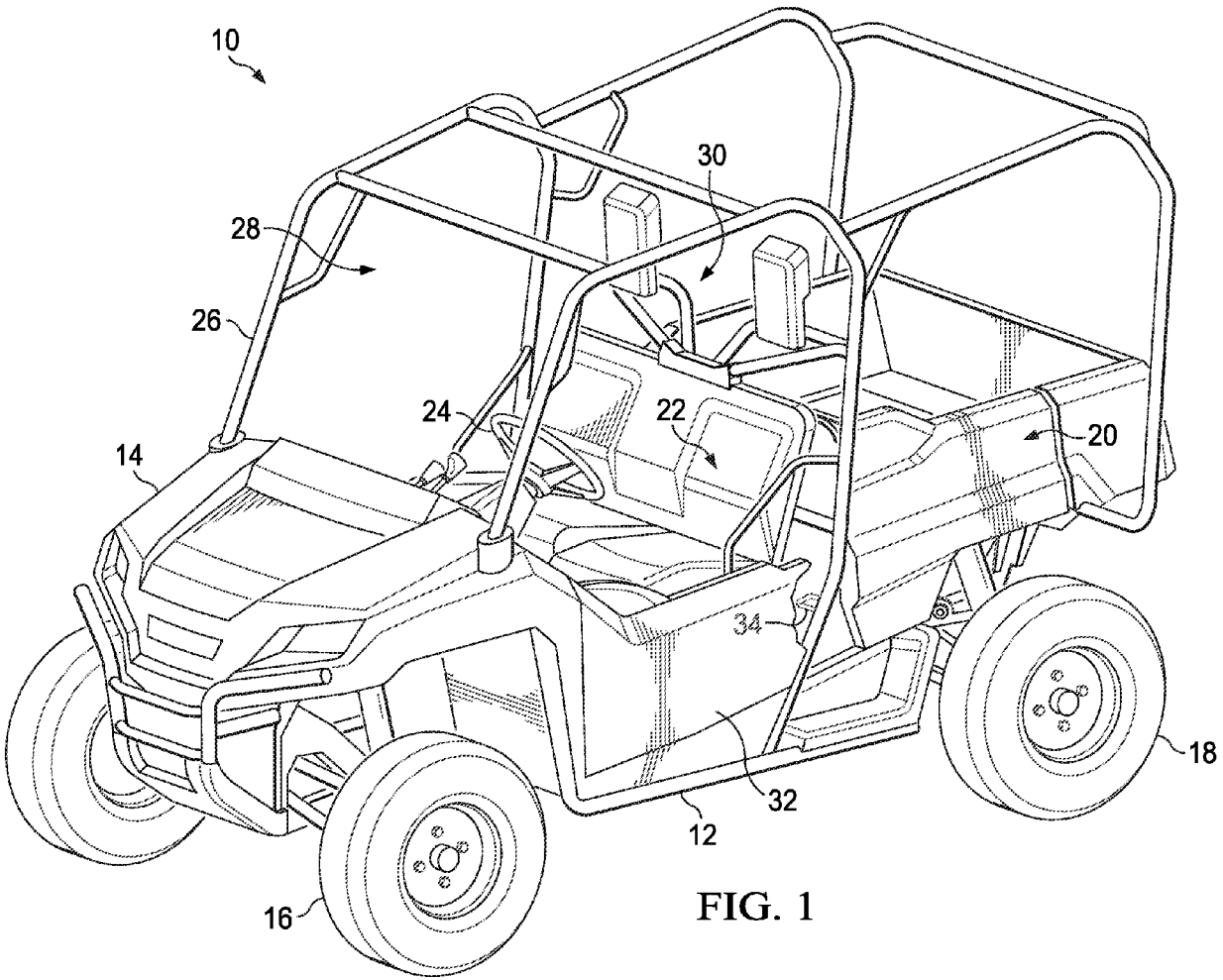
FIG. 1 is front perspective view generally depicting a multi-use vehicle ("MUV") having a door in accordance with one embodiment, wherein a portion of the door is shown in fragment in order that a striker can be seen.

Certain embodiments are hereinafter described in detail in connection with the views and examples of FIGS. 1-7. FIG. 1 illustrates a vehicle 10 that can include a frame, indicated generally at 12, and a body 14 supported by frame 12. Vehicle 10 can further include a pair of front wheels 16 and a pair of rear wheels 18. The wheels 16 and 18 can be suspended from frame 12 and can be rotatable relative to frame 12. Vehicle 10 can also include a source of motive power (not shown), which can be an internal combustion engine and/or one or more electric motors, and a drivetrain (not shown) for transferring torque from the source of motive power to the rear wheels 18 and/or the front wheels 16.

Vehicle 10 is shown to be an MUV that can include a utility bed 20 that can be fixed with respect to the body 14, or that can be selectively pivotable as a dump-type bed. The utility bed 20 can be configured to support cargo and/or passengers for transportation by the vehicle 10. In other embodiments, a vehicle might not include a utility bed.

Vehicle 10 can further include a seat 22 that can be supported by the frame 12 and/or body 14, and that can be configured to support an operator (not shown). Seat 22 can be a bucket-type seat or a bench-type seat. Vehicle 10 can also include a steering wheel 24 that can be coupled to the front wheels 16. By turning the steering wheel 24, it will be appreciated that an operator can effect steering of the vehicle 10.

Vehicle 10 can include a roll cage 26 which can be attached to, and supported by, the frame 12 and/or body 14 of vehicle 10. The roll cage 26 can at least partially define a protected area, indicated generally at 28. Seat 22 can be positioned within the protected area 28, such that an operator of vehicle 10 can be located within the protected area 28 when seated upon seat 22 during operation of vehicle 10.

The roll cage 26 can cooperate with the frame 12, the body 14, and/or a door 32 of the vehicle 10 to at least partially define one or more access openings that communicate with the protected area 28. For example, an access opening 30 is shown to be provided on the left side of vehicle 10, and a similar access opening is shown to be provided on the right side of the vehicle 10. An operator of vehicle 10 can pass through the access opening 30 into the protected area 28 when boarding the vehicle 10, and can pass from the protected area 28 through the access opening 30 when exiting the vehicle 10. It will be appreciated that an access opening can additionally, or alternatively, be at least partially defined by one or more other features of a vehicle.

The protected area 28 can be sized and configured to substantially or entirely surround one or more occupants (e.g., an operator or driver, and a passenger, each not shown) of the vehicle 10 during operation of the vehicle 10. It will be appreciated that, in one embodiment, one or more nets can be attached to a roll cage, seatbelt harnesses can be associated with one or more seats, and one or more restraint members, e.g., a hip bolster, can be provided to assist the roll cage for selectively restraining one or more operators within a vehicle.

Figure 2:
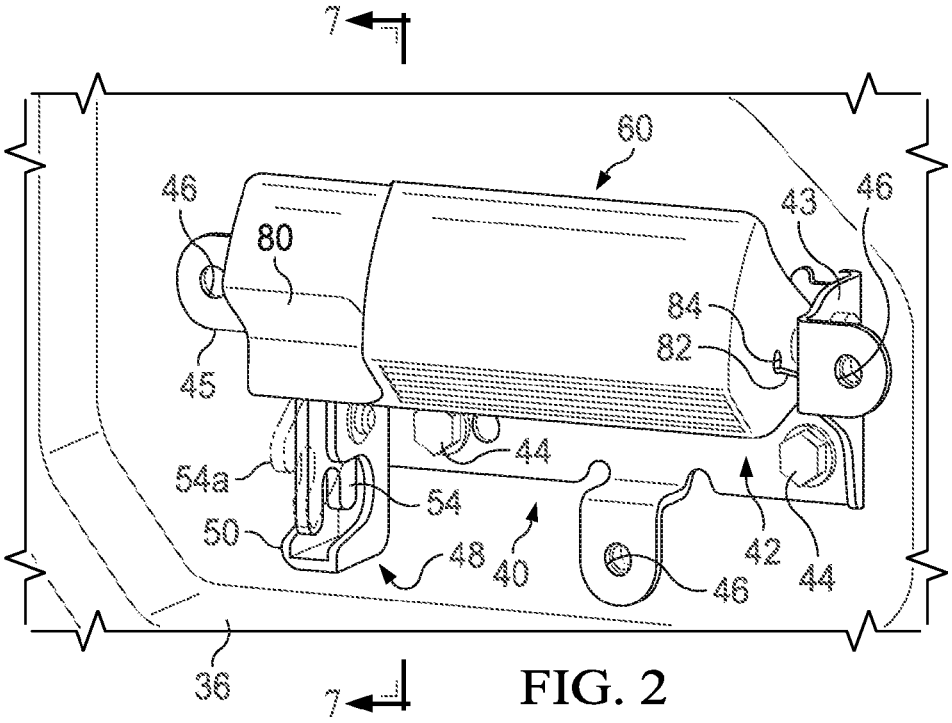
FIG. 2 is a top right perspective view depicting a portion of the door of the vehicle of FIG. 1, wherein other portions of the vehicle are removed for clarity of illustration, and wherein a striker-engagement member of a latch assembly of a door handle assembly is shown in both opened and closed positions.

In one embodiment, a forward end of the door 32 can be hingedly attached or otherwise coupled to the body 14 and/or the frame 12 such that the door 32 can swing forward and rearward between open and closed positions, respectively. The door 32 can include a door handle assembly 40, as shown in FIG. 2 and discussed below. The door handle assembly 40 can selectively lock a rearward or swinging end of the door 32 to a striker 34 coupled or attached to the body 14 and/or frame 12 of the vehicle 10, thereby locking the door 32 in a closed position as shown in FIG. 1. In an alternative embodiment, a rearward end of a door can be hingedly attached or otherwise coupled to a body and/or frame of a vehicle, such that the door can swing rearward and forward between open and closed positions, respectively.

The door handle assembly 40 can be provided as part of the door 32 in any of a variety of suitable configurations. In one embodiment, the door 32 can comprise one or more door panels, such as interior and exterior door panels that are attached together, and a portion of the door handle assembly 40 can be housed or located within a cavity disposed between the interior and exterior door panels. The interior and exterior door panels can be formed separately, or as part of a unibody or other structural arrangement, such as from plastic, metal, fiberglass, carbon fiber, or any of a variety of other suitable materials.

The door handle assembly 40 is shown in FIG. 2 to be attached to a door panel 36, which can comprise an exterior or intermediate door panel, wherein an interior door panel is not shown for clarity of illustration. More particularly, the door handle assembly 40 is shown to include a mount structure 42 which can be formed from metal and attached to the door panel 36 with bolts 44 or other fasteners, for example. In other embodiments, a mount structure of a door handle assembly can be formed integrally, as a unitary structure, with a door panel. The mount structure 42 is shown to define several apertures 46 for receiving fasteners, to facilitate attachment of an interior door panel (not shown).

Figure 3:
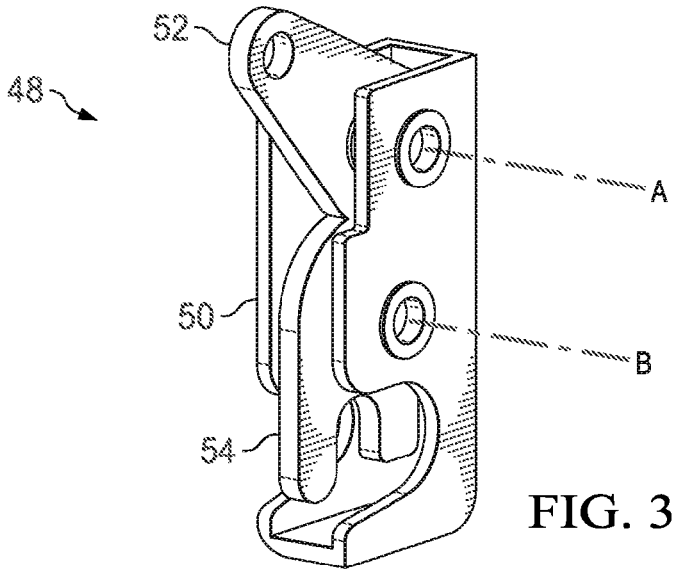
FIG. 3 is a top right perspective view depicting the latch assembly of FIG. 2, apart from the remaining components of the vehicle.
Figure 7:
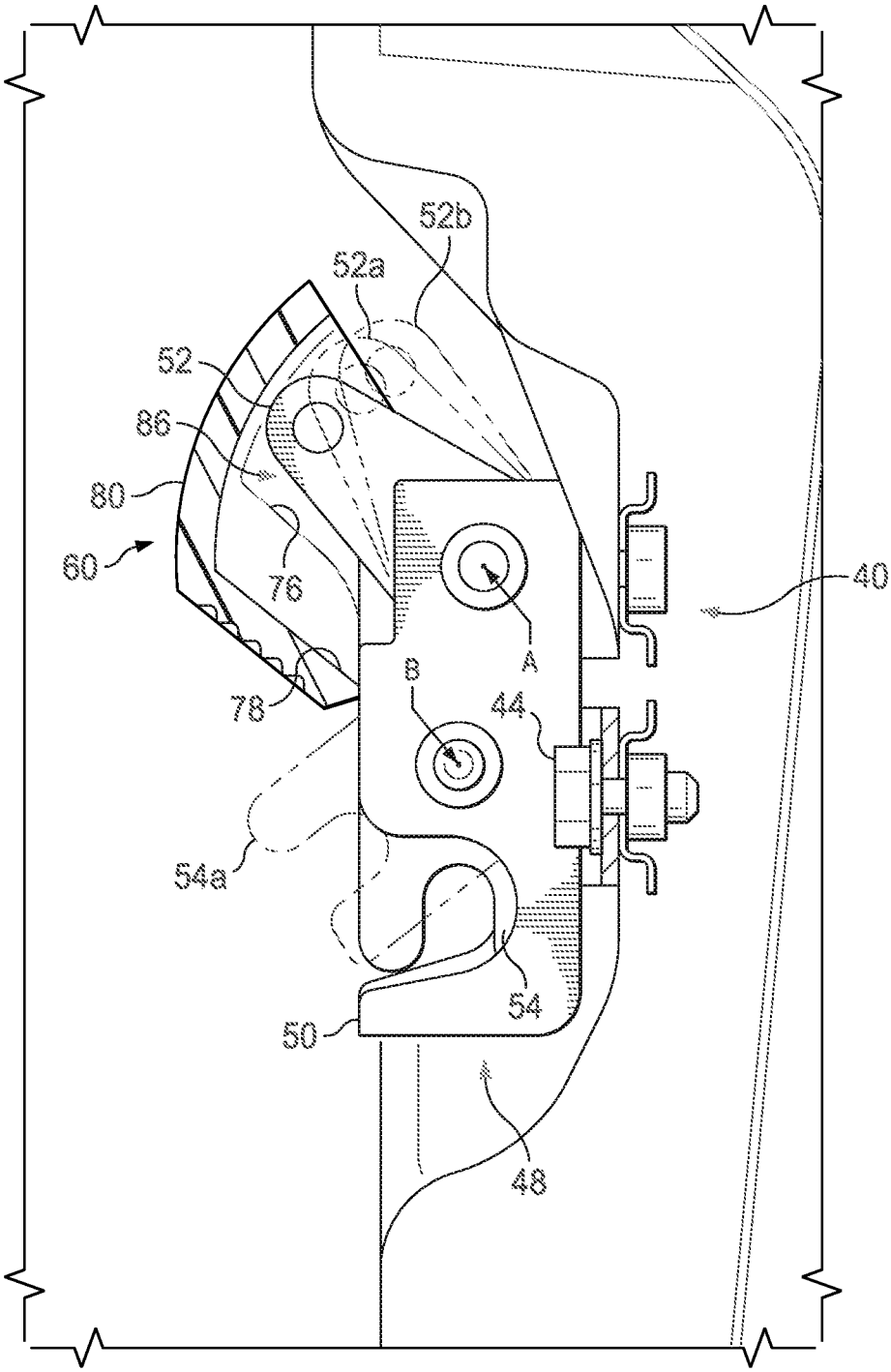
FIG. 7 is a cross-sectional view taken along lines 7-7 in FIG. 2, wherein an actuator arm of the latch assembly is shown in released, intermediate, and actuated positions.

The door handle assembly 40 can additionally include a latch assembly 48, as shown in FIGS. 2, 3 and 7. The latch assembly 48 can include a latch body 50, an actuator arm 52, and a striker-engagement member 54. The latch body 50 can be attached to the mount structure 42 such as with fasteners, welding, other mechanically interlocking features, or by being formed integrally as a unitary structure with the mount structure 42. The actuator arm 52 can be pivotally coupled with the latch body 50 and can be pivotable about an axis "A" between a released position (shown as 52 in FIG. 7), an intermediate position (shown as 52*a* in FIG. 7), and an actuated position (shown as 52*b* in FIG. 7).

The striker-engagement member 54 can be pivotally coupled with the latch body 50 and can be pivotable about an axis "B". The striker-engagement member 54 can be movable between a closed position (shown as 54 in FIGS. 2, 3 and 7) and an opened position (shown as 54*a* in FIGS. 2 and 7) at least partially in selective response to pivoting of the actuator arm 52 between the released position and the actuated position. In one embodiment, the axis A can be parallel with the axis B.

Figure 4:
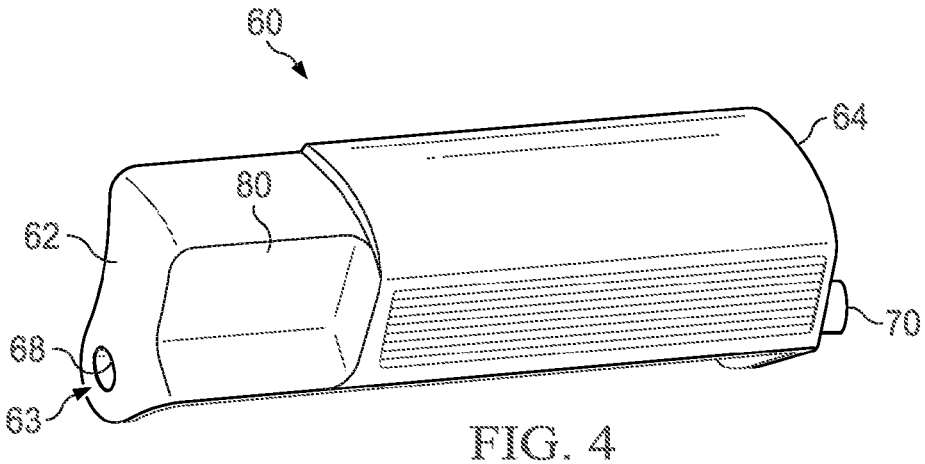
FIG. 4 is a top left perspective view generally depicting a handle of the door handle assembly of FIG. 2, apart from the remaining components of the vehicle.
Figure 5:
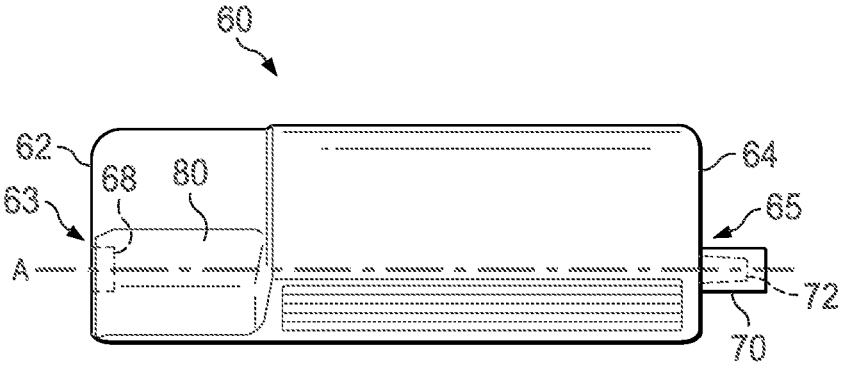
FIG. 5 is a top plan view generally depicting the handle of FIG. 4.
Figure 6:
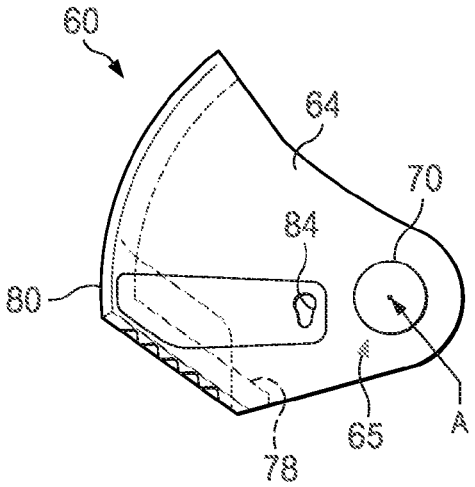
FIG. 6 is a right end view generally depicting the handle of FIG. 4.

The door handle assembly 40 can additionally include a door handle 60. The door handle 60 can include a mounting portion that is pivotally coupled with the mount structure 42, such that the door handle 60 is pivotable about the axis A between a first position and a second position. With reference to FIGS. 4-6, the mounting portion of the door handle 60 can include end walls 62 and 64 which can define respective attachment portions 63 and 65. The axis A can extend through each of the attachment portions 63 and 65, as generally shown in FIGS. 5-6. The attachment portion 63 can define an aperture 68. The mounting portion can further include an end cap 70 extending from the attachment portion 65 and along the axis A.

When assembled, the aperture 68 can facilitate pivotal coupling of the door handle 60 with the latch assembly 48, and the end cap 70 can facilitate pivotal coupling of the door handle 60 with the mount structure 42. In one embodiment, the end cap 70 can be pivotally received within a corresponding aperture provided in an upright member (43 in FIG. 2) of the mount structure 42. In one embodiment, a common shaft can pass along axis A through each of the aperture 68 and the latch assembly 48, and into a bore 72 (FIG. 5) formed in the end cap 70. In such a configuration, such an axle can also pass into or through an aperture in another upright member (e.g., 45 in FIG. 2) of the mount structure 42, in one embodiment. However, it will be appreciated that a mounting portion of a door handle can be pivotally coupled with respect to a latch assembly and a mount structure in any of a variety of other suitable configurations.

In addition to the mounting portion, the door handle 60 can include an interface portion having an inner surface and an outer surface. With reference to FIG. 7, the inner surface can include inner surface portions 76 and 78, and the outer surface is shown generally at 80. The outer surface 80 can provide an ornamental, aesthetically pleasing appearance visible to an operator of the vehicle 10. The inner surface portion 76 can be spaced from and extend generally parallel and away from the inner surface portion 78 in an offset configuration, as will be appreciated with reference to FIGS. 2-7. In this configuration, the end wall 62 can be adjacent to, and can extend generally perpendicularly from, the inner surface portion 76. Similarly, the end wall 64 can be adjacent to, and can extend generally perpendicularly from, the inner surface portion 78. In one embodiment, the door handle 60, including the interface portion and the mounting portion, can be integrally formed as a unitary structure, such as from high impact grade polypropylene or another suitable plastic formed from an injection molding process.

The door handle assembly 40 can additionally include a biasing member that is configured to bias the door handle 60 toward the first position (i.e., the position shown in FIG. 2). For example, one end of a spring 82 can be coupled to an aperture 84 in the end wall 64 of the door handle 60, and another end of the spring 82 can be coupled to the upright member 43 or other portion of the mount structure 42. It will be appreciated, however, that a door handle assembly can include a biasing member that is configured to bias a door handle in any of a variety of other suitable configurations.

In use of the door handle assembly 40, an operator can use one or more of her fingers (i.e., any digit(s) of an operator's hand, including thumb) to contact the inner surface portion 78 for lifting or pivoting the door handle 60 from the first position to the second position. As door handle 60 pivots from the first position to the second position, the inner surface portion 76 can (after passing through a gap 86 in FIG. 7) contact the actuator arm 52 and cause the actuator arm 52 to pivot from the released position (shown as 52 in FIG. 7) to the actuated position (shown as 52*b* in FIG. 7). In one embodiment, as a door handle then pivots from the second position back to the first position, the inner surface portion can contact an actuator arm and cause the actuator arm to pivot back from an actuated position to a released position. At least partially in selective response to pivoting of the actuator arm 52 between the released position and the actuated position, the striker-engagement member 54 can move between the closed position (shown as 54 in FIGS. 2, 3 and 7) and the opened position (shown as 54*a* in FIGS. 2 and 7), to facilitate its engagement and disengagement of the striker 34, and resultant locking and unlocking of the rearward end of the door 32 relative to the frame 12 and/or body 14.

In one embodiment, the striker-engagement member 54 can be biased to the open position. The actuator arm 52 can include one or more detents (not shown) to hold the striker-engagement member 54 in the closed position. When the door handle 60 pivots from the first position to the second position, the actuator arm 52 can move to release the striker-engagement member 54, so the striker-engagement member 54 can move to the opened position. The striker-engagement member 54 can be moved back to the closed position by contact with the striker 34 when the door 32 is closed.

In this configuration, it can be seen that the door handle 60 can be configured to directly contact and actuate the actuator arm 52 of the latch assembly 48, without any need for complex mechanical linkage therebetween, thereby saving weight, cost, assembly time, and complexity, while improving reliability and providing for space efficiency. While the door handle assembly 40 has been shown and described for use with a left front door of a vehicle, it will be appreciated that such a door handle assembly can alternatively or additionally be used with any of a variety of other vehicular doors such as right side doors, rear doors, and rear cargo doors, for example.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto.

What is claimed is:

1. A door handle assembly for a vehicle, the door handle assembly comprising:

a mount structure;

a door handle comprising an interface portion and a mounting portion, the interface portion comprising an inner surface and an outer surface, and the mounting portion being pivotally coupled with the mount structure such that the door handle is pivotable about a first axis between a first position and a second position; and a latch assembly comprising a latch body and an actuator arm pivotally coupled with the latch body, the latch body being attached to the mount structure, and the actuator arm being pivotable between a released position and an actuated position; wherein:

the door handle is configured to contact the actuator arm during at least a portion of the pivotal movement of the door handle from the first position to the second position, forcing the actuator arm to pivot from the released position to the actuated position;

the inner surface contacts the actuator arm during at least a portion of the pivotal movement of the door handle from the first position to the second position;

the inner surface comprises a first portion and a second portion, the first portion being spaced from and extending generally parallel and away from the second portion in an offset configuration; and the first portion is configured to contact the actuator arm, and the second portion is configured to contact at least one finger of an operator's hand, during at least a portion of the pivotal movement of the door handle from the first position to the second position.

2. The door handle assembly of claim 1, wherein the inner surface contacts the actuator arm during at least a portion of the pivotal movement of the door handle from the first position to the second position.

3. The door handle assembly of claim 1, wherein the interface portion and the mounting portion are integrally formed as a unitary structure.

4. The door handle assembly of claim 1, wherein the actuator arm of the latch assembly is pivotable about the first axis.

5. The door handle assembly of claim 4, further comprising a biasing member, the biasing member biasing the door handle toward the first position.

6. The door handle assembly of claim 4, wherein:

the latch assembly further comprises a striker-engagement member, the striker-engagement member being pivotally coupled with the latch body and pivotable about a second axis; and the striker-engagement member is movable between a closed position and an opened position at least partially in selective response to pivoting of the actuator arm between the released position and the actuated position.

7. The door handle assembly of claim 6, wherein the first axis is parallel with the second axis.

8. The door handle assembly of claim 7, wherein the interface portion and the mounting portion are integrally formed as a unitary structure.

9. The door handle assembly of claim 8, wherein:

the mounting portion comprises a first end wall and a second end wall, the first end wall being adjacent to the first portion of the inner surface, and the second end wall being adjacent to the second portion of the inner surface;

the first end wall defines a first attachment portion and the second end wall defines a second attachment portion; and the first axis extends through each of the first attachment portion and the second attachment portion.

10. The door handle assembly of claim 9, wherein:

the first attachment portion defines an aperture;

the mounting portion further comprises an end cap extending from the second attachment portion and along the first axis;

the aperture facilitates pivotal coupling of the door handle with the latch assembly; and the end cap facilitates pivotal coupling of the door handle with the mount structure.

11. The door handle assembly of claim 10, wherein the first end wall extends generally perpendicularly from the first portion of the inner surface, and wherein the second end wall extends generally perpendicularly from the second portion of the inner surface.

12. A vehicle comprising:

a frame;

a body supported by the frame;

a striker coupled with at least one of the body and the frame; and a door coupled with at least one of the body and the frame, and movable between opened and closed positions, the door comprising a door handle assembly, the door handle assembly comprising:

a mount structure;

a door handle comprising an interface portion and a mounting portion, the interface portion comprising an inner surface and an outer surface, and the mounting portion being pivotally coupled with the mount structure such that the door handle is pivotable about a first axis between a first position and a second position; and a latch assembly comprising a latch body and an actuator arm pivotally coupled with the latch body, the latch body being attached to the mount structure, and the actuator arm being pivotable between a released position and an actuated position, wherein the latch assembly is configured to selectively engage the striker to retain the door in the closed position; wherein:

the door handle is configured to contact the actuator arm during at least a portion of the pivotal movement of the door handle from the first position to the second position, forcing the actuator arm to pivot from the released position to the actuated position;

the inner surface comprises a first portion and a second portion, the first portion being spaced from and extending generally parallel and away from the second portion in an offset configuration; and the first portion is configured to contact the actuator arm, and the second portion is configured to contact at least one finger of an operator's hand, during at least a portion of the pivotal movement of the door handle from the first position to the second position.

13. The vehicle of claim 12, wherein:

the actuator arm of the latch assembly is pivotable about the first axis;

the latch assembly further comprises a striker-engagement member, the striker-engagement member being pivotally coupled with the latch body and pivotable about a second axis, and the striker-engagement member is configured to selectively engage the striker to retain the door in the closed position;

the first axis is parallel with the second axis; and the striker-engagement member is movable between a closed position and an opened position at least partially in selective response to pivoting of the actuator arm between the released position and the actuated position.

14. The vehicle of claim 13, wherein:

the mounting portion comprises a first end wall and a second end wall, the first end wall being adjacent to the first portion of the inner surface, and the second end wall being adjacent to the second portion of the inner surface;

the first end wall defines a first attachment portion and the second end wall defines a second attachment portion; and the first axis extends through each of the first attachment portion and the second attachment portion.

15. The vehicle of claim 14, wherein:

the first attachment portion defines an aperture;

the mounting portion further comprises an end cap extending from the second attachment portion and along the first axis;

the aperture facilitates pivotal coupling of the door handle with the latch assembly; and the end cap facilitates pivotal coupling of the door handle with the mount structure.

16. The vehicle of claim 15, wherein the first end wall extends generally perpendicularly from the first portion of the inner surface, and wherein the second end wall extends generally perpendicularly from the second portion of the inner surface.

17. The vehicle of claim 16, wherein the interface portion and the mounting portion are integrally formed as a unitary structure.

18. The vehicle of claim 12, wherein the interface portion and the mounting portion are integrally formed as a unitary structure.

* * * * *